US007677053B2

(12) United States Patent
Truitt

(10) Patent No.: US 7,677,053 B2
(45) Date of Patent: Mar. 16, 2010

(54) REFRIGERATION APPLIANCE DISPENSER

(76) Inventor: Karl M. Truitt, 219 S. 16th St., Richmond, IN (US) 47374

( * ) Notice: Subject to any disclaimer, the term of this patent is extended or adjusted under 35 U.S.C. 154(b) by 65 days.

(21) Appl. No.: 12/013,713

(22) Filed: Jan. 14, 2008
(Under 37 CFR 1.47)

(65) Prior Publication Data

US 2009/0013708 A1 Jan. 15, 2009

Related U.S. Application Data

(63) Continuation of application No. 11/748,754, filed on May 15, 2007, now abandoned.

(51) Int. Cl.
*B67D 5/62* (2006.01)

(52) U.S. Cl. ..... 62/264; 62/389; 141/360; 222/52; 250/223 B

(58) Field of Classification Search ..... 62/264, 62/389–390; 141/198, 351, 360; 222/52, 222/113, 129.1, 146.6; 250/223 B
See application file for complete search history.

(56) References Cited

U.S. PATENT DOCUMENTS 4,469,150 A * 9/1984 Grimaldi ..... 141/95
4,722,372 A * 2/1988 Hoffman et al. ..... 141/98
6,286,324 B1 9/2001 Pastryk et al.
6,314,745 B1 11/2001 Janke et al.
6,351,958 B1 * 3/2002 Pastryk et al. ..... 62/137
6,681,585 B1 1/2004 Stagg et al.
6,688,134 B2 2/2004 Barton et al.
6,804,974 B1 10/2004 Voglewede et al.
7,028,725 B2 4/2006 Hooker

* cited by examiner

*Primary Examiner*—William E Tapolcai
(74) *Attorney, Agent, or Firm*—Pearne & Gordon LLP

(57) ABSTRACT

A refrigeration appliance has an access door in which is located a recess containing a dispensing unit. The recess can include an upper surface, a rear surface and opposed side surfaces. The dispensing unit includes at least one of a dispensing outlet for dispensing a fluid such as water and a dispensing outlet for dispensing ice. The dispensing unit also includes at least one emitting source for emitting a beam of light and a respective receiver for receiving the beam of light from each of the at least one emitting source. Each of the at least one emitting source and the respective receiver comprise a light couple. The emitting source and receiver of each light couple are arranged so that the light passing between the emitting source and the receiver passes substantially vertically beneath at least one of the at least one of a dispensing outlet for dispensing a fluid and a dispensing outlet for dispensing ice.

19 Claims, 3 Drawing Sheets

REFRIGERATION APPLIANCE DISPENSER

BACKGROUND OF THE INVENTION

The present invention relates generally to refrigeration appliances and in particular to ice and water dispensing units associated with refrigeration appliances.

Modern refrigeration appliances, such as household refrigerators for example, often include as one of their features a dispensing unit for water and/or ice. Frequently, the dispensing unit is located within a recess in the exterior surface of a door of the appliance. The refrigeration appliance can take any one of a number of forms. For example, the refrigeration appliance can have freezer and fresh food compartments that are arranged side-by-side or the freezer compartment can be located above the fresh food compartment. In any case, separate doors can be provided for the freezer and fresh food compartments and a dispensing unit for water and/or ice can be located within the recess in the exterior of the door that closes off the freezer compartment.

The dispensing units can include both an outlet for dispensing water and an outlet for dispensing ice. Associated with the water dispensing outlet can be a lever in the form of a cradle that is pivotally attached to the rear of the dispensing unit. A torsion spring biases the lever outwardly. When water is to be dispensed, a glass or other vessel is pressed against the lever thereby operating a switch or sensor so as to complete an electrical circuit between a source of electrical power and a solenoid-operated valve connected to a source of water. The completion of the electrical circuit opens the solenoid-operated valve permitting the water to flow from the source of water to the water dispensing outlet. When the desired amount of water has been dispensed the glass is withdrawn from the lever, the torsion spring causes the switch or sensor to be disengaged and the electrical circuit deactivated so that the solenoid-operated valve closes.

Typically, the arrangement for dispensing ice that is provided is similar to the arrangement for dispensing water. In other words, a lever in the form of a cradle is associated with the ice dispensing outlet and is pivotally attached to the rear of the dispensing unit against the force of a biasing spring. When ice is to be dispensed, a glass or other container is pressed against the lever associated with the ice dispensing outlet so as to operate a switch or sensor and complete an electrical circuit that activates a device for delivering ice from a source of ice, such as an ice storage unit, to the ice dispensing outlet. After the desired amount of ice has been dispensed, the container in which the ice has been deposited is withdrawn from the lever allowing the biasing spring to disengage the switch or sensor and deactivate the device for delivering ice from the source of ice.

It is also known to actuate the water and ice dispensing units by employing two or more intersecting beams of light such as are established between infrared light-emitting diodes and complementary infrared photo-detectors.

SUMMARY OF THE INVENTION

According to one aspect, the present invention comprises a refrigeration appliance that has a surface in which is located a recess containing a dispensing unit. The recess includes an upper surface and a rear surface. The dispensing unit includes at least one of a dispensing outlet for dispensing the fluid such as water and a dispensing outlet for dispensing the ice. Each of the at least one of a dispensing outlet for dispensing a fluid and a dispensing outlet for dispensing ice is located at the upper surface of the recess and is arranged so that the dispensing of the at least one of the fluid and the ice is directed substantially downwardly within the recess. The dispensing unit also includes at least one emitting source for emitting a beam of light and a respective receiver for receiving the beam of light from each of the at least one emitting source. Each of the at least one emitting source and the respective receiver comprises a light couple. The emitting source of each light couple is located at one of the upper surface and rear surface of the recess and the receiver of the light couple is located at the other of the one of the upper surface and rear surface of the recess. The one of the emitting source and the receiver that is located at the rear surface of the recess is located downwardly of the other of the emitting source and the receiver that is located at the upper surface of the recess. The emitting source and receiver of each light couple are arranged so that the beam of light passing between the emitting source and the receiver passes substantially vertically beneath at least one of the at least one of a dispensing outlet for dispensing the fluid and a dispensing outlet for dispensing the ice.

According to yet another aspect, the dispensing unit includes a single dispensing outlet for the fluid and a single dispensing outlet for the ice that are arranged so as to substantially coincide with one another at the upper surface of the recess. A single light couple is located so that the emitting source and the receiver of the single light couple are arranged in a manner that the beam of light passing between the emitting source and the receiver passes substantially vertically beneath both the single dispensing outlet for the fluid and the single dispensing outlet for the ice.

According to still another aspect, the dispensing unit includes a single dispensing outlet for the fluid and a single dispensing outlet for the ice that are arranged so as to be spaced apart from one another at the upper surface of the recess. A first light couple is located so that the beam of light passing from the emitting source to the receiver of the first light couple passes substantially vertically beneath the dispensing outlet for the fluid and not the dispensing outlet for the ice. And a second light couple is located so that the beam of light passing from the emitting source of the second light couple to the receiver of the second light couple passes substantially vertically beneath the dispensing outlet for the ice and not the dispensing outlet for the fluid.

In all of the foregoing aspects the emitting sources can be located at either the upper surface of the recess or the rear surface of the recess and the receivers can be located at either the rear surface of the recess or the upper surface of the recess, respectively.

According to yet a further aspect, a refrigeration appliance has a surface in which is located a recess containing a dispensing unit wherein the recess comprises an upper surface and first and second opposed side surfaces. The dispensing unit comprises at least one of a dispensing outlet for dispensing a fluid and a dispensing outlet for dispensing ice, the at least one of a dispensing outlet for dispensing a fluid and a dispensing outlet for dispensing ice being located at the upper surface of the recess and arranged so that the dispensing of the at least one of the fluid and the ice is directed substantially downwardly within the recess. The dispensing unit also comprises an emitting source for emitting a beam of light and a receiver for receiving the beam of light from the emitting source, the emitting source being located at one of the opposed side walls below the upper surface of the recess and the receiver being located at the other of the opposed side walls below the upper surface of the recess. The emitting source and receiver are arranged so that the beam of light passing between the emitting source and the receiver passes substantially vertically beneath the at least one of the dispensing outlet for dispensing the fluid and the dispensing outlet for dispensing the ice.

According to still another aspect, the recess also comprises first and second opposed side surfaces, and the dispensing unit comprises at least one of a dispensing outlet for dispensing a fluid and a dispensing outlet for dispensing ice, the at least one of a dispensing outlet for dispensing a fluid and a dispensing outlet for dispensing ice being located at the upper surface of the recess and arranged so that the dispensing of the at least one of the fluid and the ice is directed substantially downwardly within the recess. The emitting source is located at the first of the opposed side walls of the recess and below the upper surface of the recess and the receiver is located at the second of the opposed side walls of the recess and below the upper surface of the recess. The emitting source and the receiver are arranged so that the beam of light passing between the emitting source and the receiver passes substantially vertically beneath the at least one of the dispensing outlet for dispensing the fluid and the dispensing outlet for dispensing the ice. In a particular embodiment of this aspect, the dispensing unit comprises both a dispensing outlet for dispensing the fluid and a dispensing outlet for dispensing the ice, and the emitting source and the receiver are arranged so that the beam of light passing between the emitting source and the receiver passes substantially vertically beneath both the dispensing outlet for dispensing the ice and the dispensing outlet for dispensing the ice. Additionally, the dispensing outlet for the fluid and the dispensing outlet for the ice can be arranged so as to substantially coincide with one another at the upper surface of the recess and the emitting source and the receiver can be further arranged so that the beam of light passes along a substantially horizontal path.

In all the foregoing aspects, the beam of light can comprise infrared light.

BRIEF DESCRIPTION OF THE DRAWINGS

Like reference numerals in the various figures refer to like elements in the several disclosed embodiments of the present invention.

DETAILED DESCRIPTION OF EMBODIMENTS OF THE INVENTION

Figure 1:
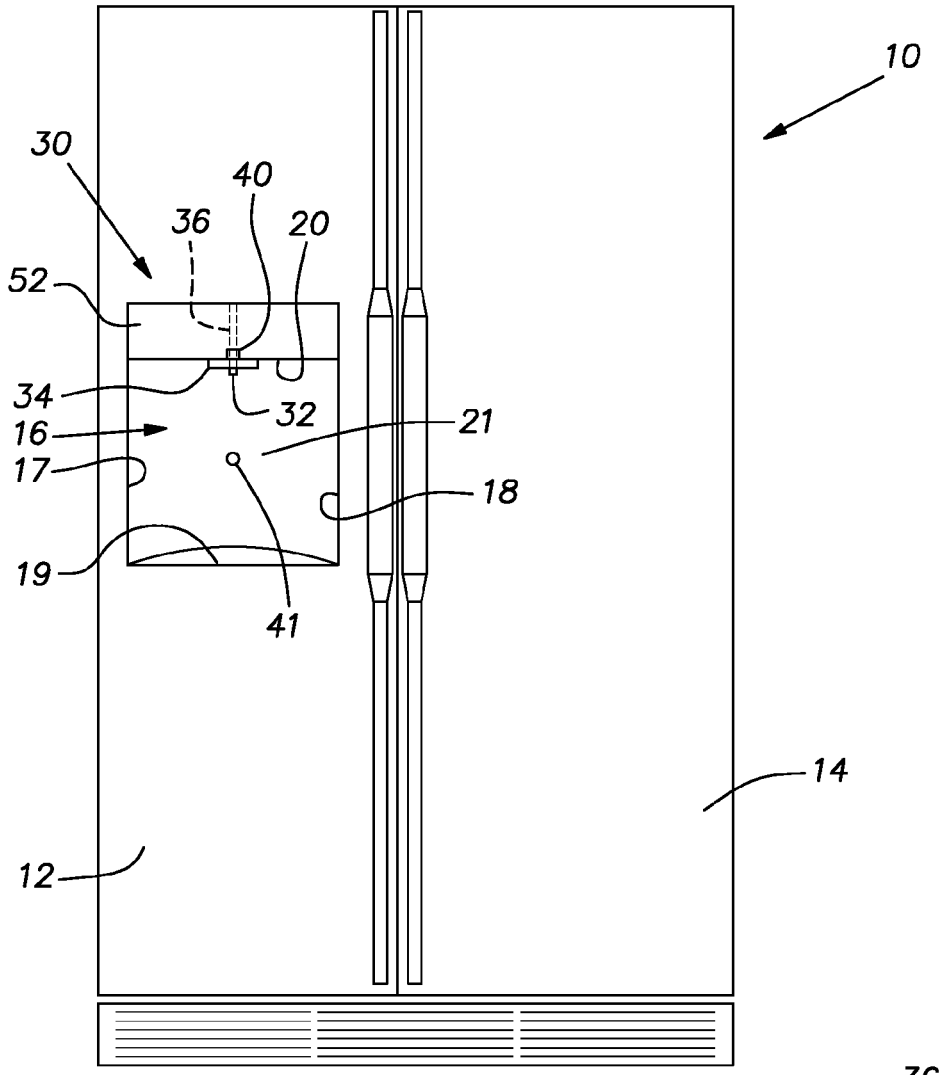
FIG. 1 is a somewhat schematic front elevational view of a side-by-side refrigerator illustrating one embodiment of a dispensing unit located in a recess in the freezer compartment door of the refrigerator.

Referring to FIG. 1, wherein a first embodiment of the invention is illustrated, a refrigeration appliance in the form of a refrigerator 10 for use in the home comprises side-by-side freezer and fresh food compartments. A door 12 provides a means for gaining access to the freezer compartment, and a door 14 provides a means for gaining access to the fresh food compartment of the refrigerator.

Located generally centrally at the surface or exterior of the door 12 is a dispensing unit indicated generally at 30. As can best be seen in FIG. 2, the dispensing unit 30 is located in a recess 16 in the door 12. The recess comprises side walls or surfaces 17 and 18 that are opposite one another, a bottom or lower wall or surface 19, an upper or top wall or surface 20 and a back or rear wall or surface 21. A dispensing outlet 32 for dispensing water and a dispensing outlet 34 for dispensing ice are located at the upper surface 20 of the recess 16. In the embodiment shown in FIGS. 1 and 2, the single dispensing outlet 32 for the water and the single dispensing outlet 34 for the ice are arranged so as to substantially coincide with one another at the upper surface 20 of the recess 16. The bottom surface 19 of the recess 16 can include a drain (not show) for draining away excess water from the water dispensing outlet 32 and water formed from melting ice from the ice dispensing outlet 34 that comes to rest on the bottom surface 19.

A water line 36 extends from the water dispensing outlet 32 to a source of the water not shown. The source of water can be, for example, a water reservoir connected to the household water supply system or the household water supply itself or such other sources as are familiar to those having ordinary skill in the art. A solenoid-operated valve not shown, and whose operation can be controlled by a microprocessor, for example, as discussed below, can be located in the water line 36.

The ice dispensing outlet 34 comprises essentially an opening in the upper surface 20 of the recess 16. The opening is in communication with a source of ice such as, for example, the ice storage bin of an ice making unit (not shown) located in the freezer compartment of the refrigerator. Typically, as is familiar to those of ordinary skill in the art, the ice is delivered from the ice storage bin to the ice dispensing outlet by an auger which upon activation rotates so as to drive the ice from the storage bin to the ice dispensing outlet. Activation of the auger can be accomplished by the microprocessor that also controls the operation of the solenoid-operated valve located in water line 36.

The dispensing unit of the invention further comprises an optical sensing system located within the recess 16. In general, the optical sensing system functions to cause water through water dispensing outlet 32 and ice through ice dispensing outlet 34 to be dispensed substantially downwardly from their respective outlets within the recess 16.

Figure 2:
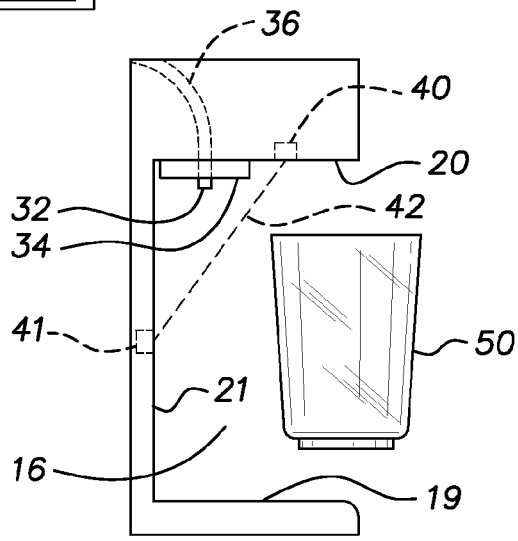
FIG. 2 is a side view of the embodiment of the dispensing unit illustrated in FIG. 1.

In the embodiment of FIGS. 1 and 2, the optical sensing system comprises a light-emitting source 40 such as an infrared light-emitting diode for emitting a beam of light 42 and a receiver such as an infrared photo-detector or phototransistor 41 for receiving the beam of light. The light-emitting source 40 is located at the upper surface 20 of the recess 16 above the receiver 41 which is located at the rear surface 21 of the recess in the embodiment of FIGS. 1 and 2. The emitting source 40 and the receiver 41 comprise a light couple and are arranged so that the beam of light 42 passing between the emitting source 40 and the receiver 41 in the embodiment of FIGS. 1 and 2 passes substantially vertically beneath the water dispensing outlet 32 and the ice dispensing outlet 34. That is, a vertical line extending downwardly from the outlets 32 and 34 will substantially intersect the beam of light 42.

It will be understood by those having ordinary skill in the art that the optical sensing system can employ a source and receiver of optical energy of a type different from the infrared light-emitting diode and infrared photo-detector referred to above. For example, sources and receivers employing ordinary white light can be used. Additionally, the light-emitting source may be located at the rear surface 21 of the recess 16 and the receiver at the upper surface 20 of the recess above the light-emitting source.

It will also be understood by those having ordinary skill in the art that the source and receiver of optical energy, such as the light-emitting source 40 and receiver 41, can be part of an electrical circuit that includes a microprocessor that is operationally arranged to open and close the solenoid-operated valve through which water flows to the water dispensing outlet 32 and activate the auger that dispenses ice through the ice dispensing outlet 34. Thus, when a vessel such as a glass 50 is inserted within the recess 16 to a sufficient depth to disturb the light beam 42, the electrical circuit of which the light-emitting source and the receiver are a part will provide a signal to the microprocessor for the purpose of causing the microprocessor to either open the solenoid-operated valve or activate the auger. Which of these two functions is carried out is controlled by the microprocessor which can be appropriately programmed using information that is input by a user to a user interface 52 that is electrically connected to the microprocessor.

The dispensing of the water or ice will continue so long as the glass 50 is located in a position so as to disturb the light beam 42. However, once the glass is withdrawn so that the light beam can be reestablished, the electrical circuit will signal the microprocessor to either turn off the solenoid-operated valve that controls the flow of water or deactivate the auger that dispenses the ice depending on which of the two substances was being dispensed.

From the foregoing description, it will be understood that there is provided in the first embodiment of the present invention, as illustrated in FIGS. 1 and 2, a refrigeration appliance 10 that has an surface 12 in which is located a recess 16 containing a dispensing unit 30. The recess 16 includes at least an upper surface 20 and a rear surface 21. The dispensing unit 30 comprises at least one of a dispensing outlet 32 for dispensing a fluid such as water and a dispensing outlet 34 for dispensing ice. Each of the at least one of a dispensing outlet for dispensing a fluid and a dispensing outlet for dispensing ice is located at the upper surface 20 of the recess 16 and is arranged so that the dispensing of the at least one of the fluid and the ice is directed substantially downwardly within the recess. The dispensing unit also includes at least one emitting source 40 for emitting a beam of light 42 and a respective receiver 41 for receiving the beam of light from each of the at least one emitting source. Each of the at least one emitting source 40 and the respective receiver 41 comprises a light couple. The emitting source 40 of each light couple is located at one of the upper surface 12 and the rear surface 21 of the recess 16 and the receiver 41 of the light couple is located at the other of the one of the upper surface 20 and the rear surface 21 of the recess, with the one of the emitting source 40 and the receiver 41 that is located at the rear surface 21 of the recess 16 being located downwardly of the other of the emitting source 40 and the receiver 41 that is located at the upper surface 20 of the recess. The emitting source 40 and receiver 41 of each light couple are arranged so that the beam of light 42 passing between the emitting source 40 and the receiver 41 passes substantially vertically beneath at least one of the at least one of the dispensing outlet 32 for dispensing the fluid and the dispensing outlet 34 for dispensing the ice.

The first embodiment of the invention illustrated in FIGS. 1 and 2, while it is appropriately described in broad terms as set forth in the previous paragraph, can also be described in more particular terms as including a dispensing unit 30 that comprises a single dispensing outlet 32 for the water and a single dispensing outlet 34 for the ice. The dispensing outlets 30 and 32 are arranged so as to substantially coincide with one another at the upper surface 20 of the recess 16. The dispensing unit 30 in the first embodiment also comprises a single light couple that is located so that the emitting source 40 and the receiver 41 of the single light couple are arranged in a manner that the beam of light 42 passing between the emitting source and the receiver passes substantially vertically beneath the both the single dispensing outlet 32 for the fluid and the single dispensing outlet 34 for the ice. Also in the first embodiment of the invention as illustrated in FIGS. 1 and 2, the emitting source 40 of the single light couple is located at the upper surface 20 of the recess 16 and the receiver 41 of the single light couple is located at the rear surface 21 of the recess 16.

Figure 3:
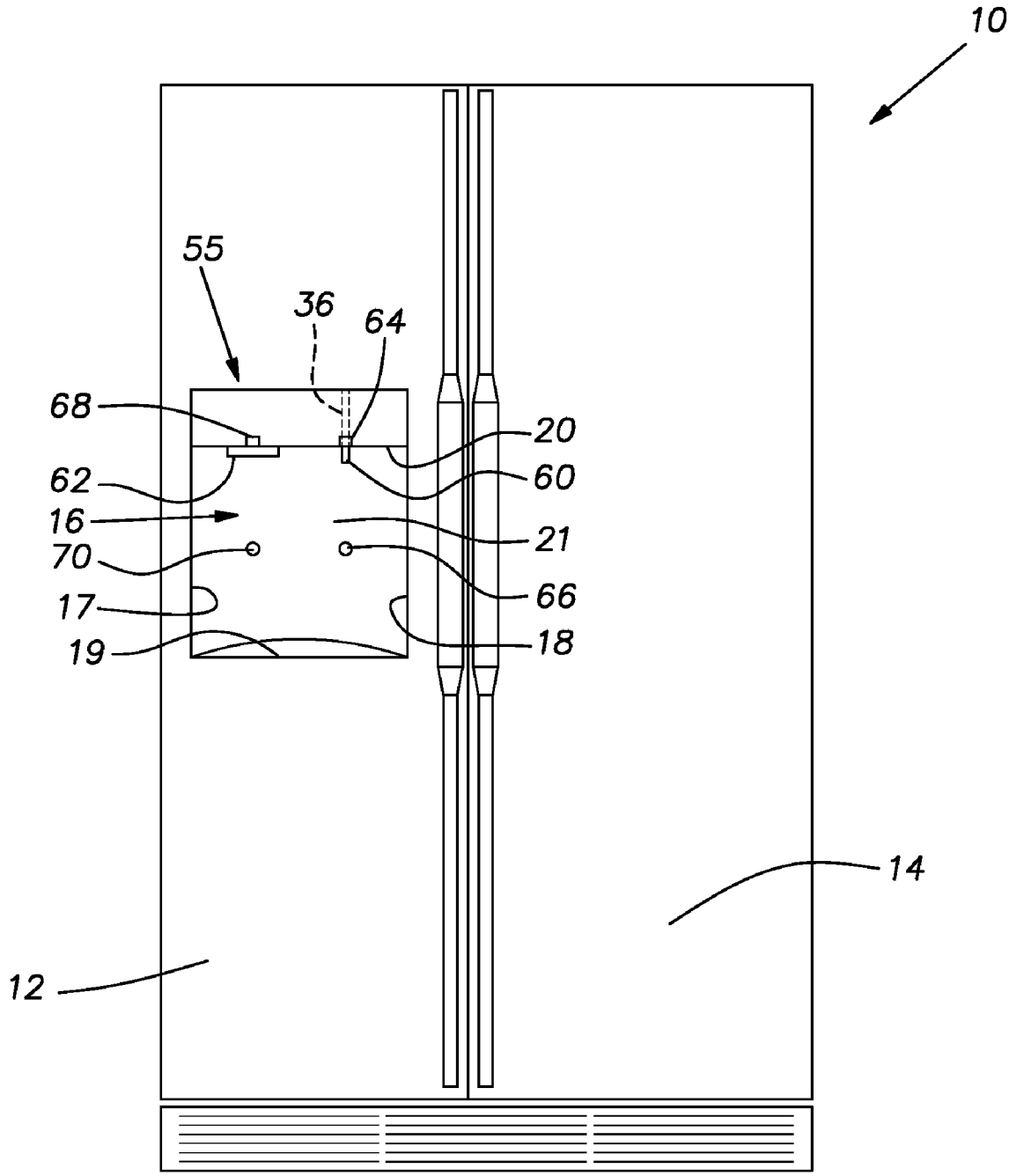
FIG. 3 is a somewhat schematic front elevational view of a side-by-side refrigerator illustrating a second embodiment of a dispensing unit located in a recess in the freezer compartment door of the refrigerator.

A second embodiment of the invention is shown in FIG. 3. This embodiment of the invention also includes a recess or cavity 16 that is located in the surface or access door 12 of a freezer compartment of a refrigerator 10. As with the first embodiment described above, the recess 16 of the second embodiment includes an upper surface 20, a lower surface 19, opposite side surfaces 17 and 18 and a rear surface 21. However, in the second embodiment, the dispensing unit includes a single dispensing outlet for water 60 and a single dispensing outlet for ice 62 that are arranged so as to be spaced apart from one another at the upper surface 20 of the recess 16 across the width of the access door 12 and not coincide with one another as is the case with the dispensing outlets of the first embodiment. A first light couple, comprising a light-emitting source 64 such as an infrared light-emitting diode for emitting a beam of light and a receiver 66 such as an infrared photodetector or phototransistor for receiving the beam of light, is located so that the light passing from the light-emitting source to the receiver of the first light couple passes substantially vertically beneath the dispensing outlet 60 for the water in a similar manner as illustrated for the first embodiment in FIG. 2. A second light couple, comprising a light emitting source 68 such as an infrared light-emitting diode for emitting a beam of light and a receiver 70 such as an infrared photodetector or phototransistor for receiving the beam of light, is located so that the light passing from the emitting source to the receiver of the second light couple passes substantially vertically beneath the dispensing outlet 62 for the ice in a similar manner as described for the light-emitting source 64, the receiver 66 and the outlet 60. In both instances the light-emitting sources are located above the respective receivers.

As indicated above with respect to the first embodiment of the invention, the first and second light couples can employ a source and receiver of optical energy of a type different from the infrared light-emitting diode and photo-detector referred to. For example, sources and receivers employing ordinary white light can be used. Additionally, the light-emitting sources may be located at the rear surface 21 of the recess 16 and the receivers can be located at the upper surface 20 of the recess and above the light-emitting sources.

It will also be understood by those having ordinary skill in the art that the light-emitting sources 64 and 68 and the receivers 66 and 70 can be part of an electrical circuit that includes a microprocessor that is operationally arranged to open and close the solenoid-operated valve through which water flows to the water dispenser 60 and the auger that dispenses ice through the ice dispenser 62. Thus when a vessel such as a glass is inserted within the recess 16 to a sufficient depth to disturb the light beam established between emitter 60 and receiver 66, the electrical circuit of which the emitter and the receiver are a part will provide a signal to the microprocessor for the purpose of opening the solenoid-operated valve. Similarly, when a vessel such as a glass is inserted within the recess 16 to a sufficient depth to disturb the light beam established between emitter 62 and receiver 70, the electrical circuit of which the emitter and the receiver are a part will provide a signal to the microprocessor for the purpose of activating the auger so that ice will be dispensed through dispensing outlet 62. In this case, it is not necessary to provide a user interface where a user must select which of the two substances, water or ice, is to be dispensed, although such an interface can be provided for other purposes.

Based on the foregoing description, it can be understood that there is provided in the second embodiment of the present invention, as illustrated in FIG. 3, a refrigeration appliance 10 that has a surface 12 in which is located a recess 16 containing a dispensing unit 55. The recess 16 includes at least an upper surface 20 and a rear surface 21. The dispensing unit 55 comprises at least one of a dispensing outlet 60 for dispensing a fluid such as water and a dispensing outlet 62 for dispensing ice. Each of the at least one of a dispensing outlet for dispensing a fluid and a dispensing outlet for dispensing ice is located at the upper surface 20 of the recess 16 and is arranged so that the dispensing of the at least one of the fluid and the ice is directed substantially downwardly within the recess. The dispensing unit also includes at least one emitting source (64, 68) for emitting a beam of light and a respective receiver (66, 70) for receiving the beam of light from each of the at least one emitting source. Each of the at least one emitting source (64, 68) and the respective receiver (66, 70) comprises a light couple. The emitting source (64, 68) of each light couple is located at one of the upper surface 12 and rear surface 21 of the recess 16 and the receiver (66, 70) of the light couple is located at the other of the one of the upper surface 20 and rear surface 21 of the recess, with the one of the emitting source (64, 68) and the receiver (66, 70) that is located at the rear surface 21 of the recess 16 being located downwardly of the other of the emitting source (64, 68) and the receiver (66, 70) that is located at the upper surface 20 of the recess. The emitting source (64, 68) and receiver (66, 70) of each light couple are arranged so that the beam of light passing between the emitting source (64, 68) and the receiver (66, 70) passes substantially vertically beneath at least one of the at least one of the dispensing outlet 60 for dispensing a fluid and a dispensing outlet 62 for dispensing ice.

The second embodiment of the invention, while it is appropriately described in broad terms as set forth in the previous paragraph, can also be described in more particular terms wherein the dispensing unit 55 includes a single dispensing outlet 60 for the water and a single dispensing outlet 62 for the ice that are arranged so as to be spaced apart from one another at the upper surface 20 of the recess 16. A first light couple is located so that the beam of light passing from the emitting source 64 to the receiver 66 passes substantially vertically beneath the dispensing outlet 60 for the fluid and not the dispensing outlet 62 for the ice. A second light couple is located so that the beam of light passing from the emitting source 68 of the second light couple to the receiver 70 of the second light couple passes substantially vertically beneath the dispensing outlet 62 for the ice and not the dispensing outlet 60 for the fluid. Also in the second embodiment, the emitting sources 64 and 68 of the first and second light couples are located at the upper surface 20 of the recess 16 and the receivers 66 and 70 of the first and second light couples are located at the rear surface 21 of the recess 16.

Figure 4:
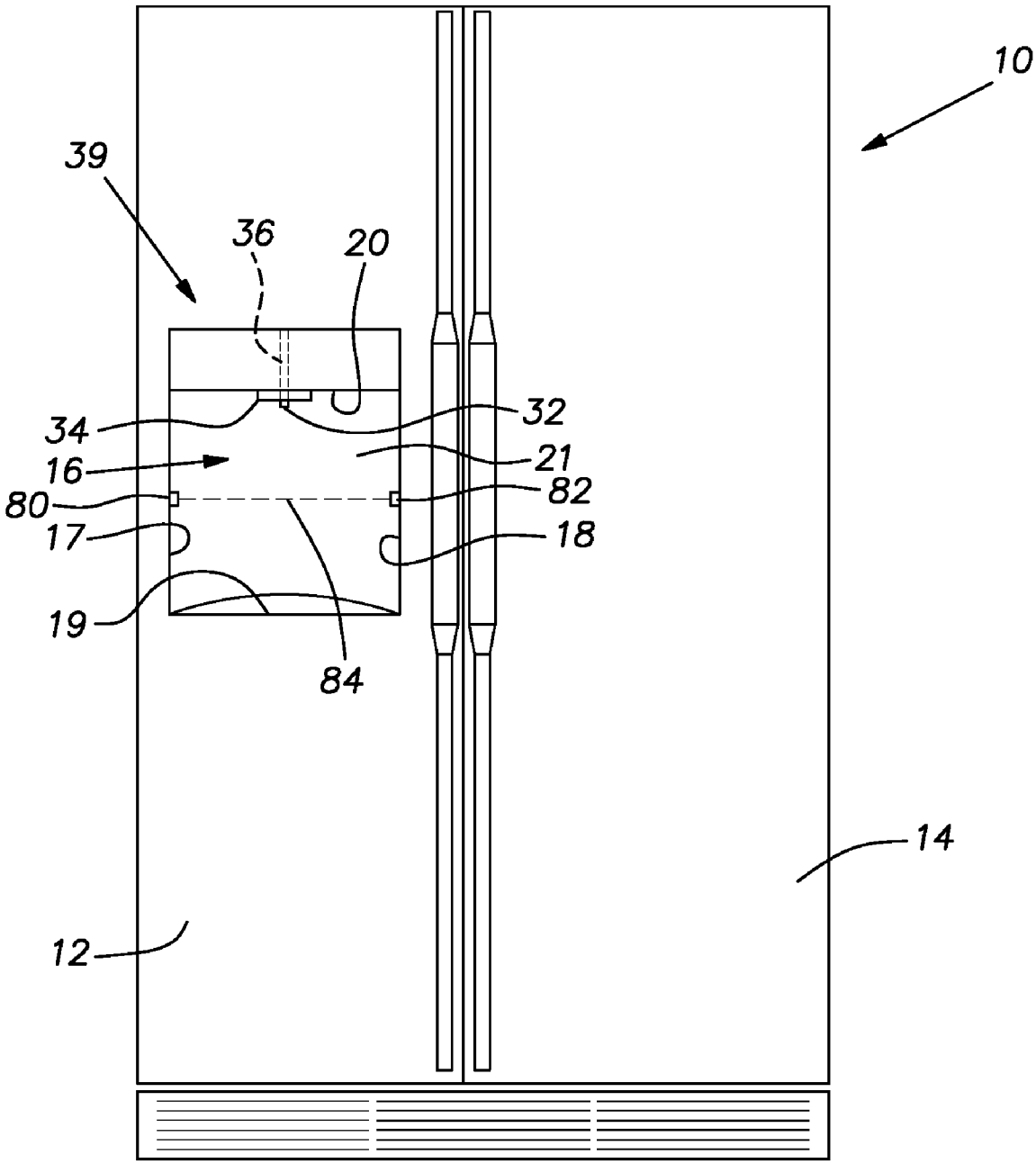
FIG. 4 is a somewhat schematic front elevational view of a side-by-side refrigerator illustrating a third embodiment of a dispensing unit located in a recess in the freezer compartment door of the refrigerator.

A third embodiment of the invention is shown in FIG. 4. This embodiment of the invention also includes a recess or cavity 16 that is located in the surface 12 of a freezer compartment of a refrigerator 10. As with the first embodiment described above, the recess 16 of the second embodiment includes an upper surface 20, a lower surface 19, opposite side surfaces 17 and 18 and a rear surface 21. The third embodiment like the first embodiment includes the dispensing outlet 32 for dispensing water and the dispensing outlet 34 for dispensing ice. Both dispensing outlets are located at the upper surface 20 of the recess 16. Also as with the first embodiment, the single dispensing outlet 32 for the water and the single dispensing outlet 34 for the ice in the third embodiment are arranged so as to substantially coincide with one another at the upper surface 20 of the recess 16. The provision of water to the dispensing outlet 32 and ice to the dispensing outlet 34 can be accomplished in the same manner as described above with reference to the first embodiment of the invention.

The dispensing unit of the third embodiment of the invention further comprises an optical sensing system located within the recess 16 as do the first and second embodiments and as with the optical sensing systems of the first and second embodiments, the optical sensing system of the third embodiment functions to cause water, through water-dispensing outlet 32, and ice, through ice dispensing outlet 34, to be dispensed substantially downwardly from their respective outlets within the recess 16.

In the third embodiment, as illustrated in FIG. 4, the optical sensing system comprises a light-emitting source 80 such as an infrared light-emitting diode for emitting a beam of light 84 and a receiver 82 such as an infrared photo-detector or phototransistor for receiving the beam of light. The light-emitting source 80 is located at one side surface 17 of the recess 16 and the receiver 82 which is located at the other side surface 18 of the recess. Both the source 80 and the receiver are spaced above the bottom surface 19 of the recess 16. The emitting source 80 and the receiver 82 comprise a light couple and are arranged so that the beam of light 84 passing between the emitting source 80 and the receiver 82 passes substantially vertically beneath the water dispensing outlet 32 and the ice dispensing outlet 34. That is to say that a vertical line extending downwardly from the outlets 32 and 34 will substantially intersect the beam of light 84. As shown in FIG. 4, the emitting source 80 and the receiver 82 can be arranged so that the beam of light 84 passes along a substantially horizontal path.

As discussed above with respect to the first and second embodiments, the optical sensing system of the third embodiment can employ a source and receiver of optical energy of a type different from the infrared light-emitting diode and infrared photo-detector referred to above. For example, sources and receivers employing ordinary white light can be used. Additionally, the light-emitting source may be located at the side surface 18 of the recess 16 and the receiver at the side surface 17 of the recess.

Also as discussed above with respect to the first and second embodiments, the light-emitting source 80 and receiver 82 can be part of an electrical circuit that includes a microprocessor that is operationally arranged to open and close the solenoid-operated valve through which water flows to the water dispensing outlet 32 and activate the auger that dispenses ice through the ice dispensing outlet 34. Consequently, when a vessel such as a glass 50 is inserted within the recess 16 to a sufficient depth to disturb the light beam 84, the electrical circuit of which the light-emitting source and the receiver are a part will provide a signal to the microprocessor for the purpose of causing the microprocessor to either open the solenoid-operated valve or activate the auger. Which of these two functions is carried out is also controlled by the microprocessor which can be appropriately programmed through information that is input by a user to a user interface 52 that is electrically connected to the microprocessor.

Based on the foregoing description, it will be understood that in the third embodiment of the invention, as illustrated in FIG. 4, the refrigeration appliance 10 has a surface 12 in which is located a recess 16 containing a dispensing unit 39. The recess comprises an upper surface 20 and first and second opposed side surfaces 17 and 18. The dispensing unit comprises at least one of a dispensing outlet 32 for dispensing a fluid and a dispensing outlet 34 for dispensing ice. The at least one of a dispensing outlet 32 for dispensing a fluid and a dispensing outlet 34 for dispensing ice is located at the upper surface 20 of the recess 16 and is arranged so that the dispensing of the at least one of the fluid and the ice is directed substantially downwardly within the recess 16. The dispensing unit further comprises an emitting source 80 for emitting a beam of light 84 and a receiver 82 for receiving the beam of light from the emitting source. The emitting source 80 is located at the first opposed side surface 17 below the upper surface 20 of the recess 16 and the receiver 82 is located at the other of the second opposed side surface 18 below the upper surface 21 of the recess 16. The emitting source 80 and the receiver 82 are arranged so that the beam of light 84 passing between the emitting source and the receiver passes substantially vertically beneath the at least one of the dispensing outlet 32 for dispensing the fluid and the dispensing outlet 34 for dispensing the ice.

The third embodiment can be described with more particularity with reference to the dispensing unit 39 as comprising a dispensing outlet 32 for dispensing the fluid and a dispensing outlet 34 for dispensing the ice and with the emitting source 80 and the receiver 82 arranged so that the beam of light 84 passes between the emitting source and the receiver substantially vertically beneath both the dispensing outlet 32 for the fluid and the dispensing outlet for the ice. In even more detailed terms, the dispensing outlet 32 for the fluid and the dispensing outlet 34 for the ice are arranged so as to substantially coincide with one another at the upper surface 20 of the recess 16.

While certain embodiments of the invention have been shown and described herein, it is to be understood that the invention is not so limited. For example, while the three embodiments of the invention have been described with reference to a side-by-side household refrigerator, the present invention can be applied to other types of refrigeration appliances including, for example, refrigerators where the fresh food compartment is located above or below the freezer compartment. Additionally, the dispensing unit of the invention can be located other than in a door of the refrigerator such as within the interior of a refrigeration appliance. Further, the dispensing outlet for dispensing water can be connected to a source of a fluid other than water such as for example a source of a soft drink. Thus, the invention covers and includes any and all modifications and variations that are encompassed by the following claims.

What is claimed is:

1. A refrigeration appliance having a surface in which is located a recess containing a dispensing unit, the recess comprising an upper surface and a rear surface, and the dispensing unit comprising:

at least one of a dispensing outlet for dispensing a fluid and a dispensing outlet for dispensing ice, the at least one of a dispensing outlet for dispensing a fluid and a dispensing outlet for dispensing ice being located at the upper surface of the recess and arranged so that the dispensing of the at least one of the fluid and the ice is directed substantially downwardly within the recess;

at least one emitting source for emitting a beam of light and a respective receiver for receiving the beam of light from each of the at least one emitting source, each of the at least one emitting source and the respective receiver comprising a light couple, the emitting source of each light couple being located at one of the upper surface and the rear surface of the recess and the receiver of the light couple being located at the other of the one of the upper surface and the rear surface of the recess, with the one of the emitting source and the receiver that is located at the rear wall of the recess being located downwardly of the other of the emitting source and the receiver that is located at the upper wall of the recess, and the emitting source and receiver of each light couple being arranged so that the beam of light passing between the emitting source and the receiver passes substantially vertically beneath at least one of the dispensing outlet for dispensing a fluid and the dispensing outlet for dispensing ice.

2. The refrigeration appliance of claim 1 wherein the beam of light comprises infrared light.

3. The refrigeration appliance of claim 1 wherein the emitting source of each light couple is located at the upper surface of the recess and the receiver for each light couple is located at the rear surface of the recess.

4. The refrigeration appliance of claim 3 wherein the beam of light comprises infrared light.

5. The refrigeration appliance of claim 1 wherein the dispensing unit comprises a single dispensing outlet for the fluid and a single dispensing outlet for the ice that are arranged so as to substantially coincide with one another at the upper surface of the recess, and a single light couple that is located so that the emitting source and the receiver of the single light couple are arranged in a manner that the beam of light passing between the emitting source and the receiver passes substantially vertically beneath both the single dispensing outlet for the fluid and the single dispensing outlet for the ice.

6. The refrigeration appliance of claim 5 wherein the emitting source of the single light couple is located at the upper surface of the recess and the receiver of the single light couple is located at the rear surface of the recess.

7. The refrigeration appliance of claim 6 wherein the beam of light comprises infrared light.

8. The refrigeration appliance of claim 1 wherein the dispensing unit comprises a single dispensing outlet for the fluid and a single dispensing outlet for ice that are arranged so as to be spaced apart from one another at the upper surface of the recess, a first light couple that is located so that the beam of light passing from the emitting source to the receiver of the first light couple passes substantially vertically beneath the dispensing outlet for the fluid and not the dispensing outlet for the ice, and a second light couple that is located so that the beam of light passing from the emitting source of the second light couple to the receiver of the second light couple passes substantially vertically beneath the dispensing outlet for the ice and not the dispensing outlet for the fluid.

9. The refrigeration appliance of claim 8 wherein the emitting sources of the first and second light couples are located at the upper surface of the recess and the receivers of the first and second light couples are located at the rear surface of the recess.

10. The refrigeration appliance of claim 9 wherein each beam of light comprises infrared light.

11. A refrigeration appliance having a surface in which is located a recess containing a dispensing unit, the recess comprising an upper surface and first and second opposed side surfaces, and the dispensing unit comprising:

at least one of a dispensing outlet for dispensing a fluid and a dispensing outlet for dispensing ice, the at least one of a dispensing outlet for dispensing a fluid and a dispensing outlet for dispensing ice being located at the upper surface of the recess and arranged so that the dispensing of the at least one of the fluid and the ice is directed substantially downwardly within the recess;

an emitting source for emitting a beam of light and a receiver for receiving the beam of light from the emitting source, the emitting source being located at the first of the opposed side walls of the recess and below the upper surface of the recess and the receiver being located at the second of the opposed side walls of the recess and below the upper surface of the recess, and the emitting source and the receiver being arranged so that the beam of light passing between the emitting source and the receiver passes substantially vertically beneath the at least one of the dispensing outlet for dispensing the fluid and the dispensing outlet for dispensing the ice; and wherein the dispensing outlet for the fluid and the dispensing outlet for the ice are arranged so as to substantially coincide with one another at the upper surface of the recess.

12. The refrigeration appliance of claim 11 wherein the beam of light comprises infrared light.

13. The refrigeration appliance of claim 11 wherein the emitting source and the receiver are further arranged so that the beam of light passes along a substantially horizontal path.

14. The refrigeration appliance of claim 13 wherein the beam of light comprises infrared light.

15. The refrigeration appliance of claim 11 wherein the dispensing unit comprises a dispensing outlet for dispensing the fluid and a dispensing outlet for dispensing the ice, and the emitting source and the receiver are arranged so that the beam of light passing between the emitting source and the receiver passes substantially vertically beneath both the dispensing outlet for dispensing the ice and the dispensing outlet for dispensing the ice.

16. The refrigeration appliance of claim 15 wherein the emitting source and the receiver are further arranged so that the beam of light passes along a substantially horizontal path.

17. The refrigeration appliance of claim 16 wherein the beam of light comprises infrared light.

18. The refrigeration appliance of claim 1 wherein the beam of light comprises white light.

19. The refrigeration appliance of claim 11 wherein the beam of light comprises white light.

* * * * *